US011486112B2

(12) United States Patent
Bell

(10) Patent No.: US 11,486,112 B2
(45) Date of Patent: Nov. 1, 2022

(54) IMPLEMENT QUICK CONNECT SYSTEM

(71) Applicant: Samuel W. Bell, Goldthwaite, TX (US)

(72) Inventor: Samuel W. Bell, Goldthwaite, TX (US)

( * ) Notice: Subject to any disclaimer, the term of this patent is extended or adjusted under 35 U.S.C. 154(b) by 0 days.

(21) Appl. No.: 17/327,635

(22) Filed: May 21, 2021

(65) Prior Publication Data

US 2021/0363723 A1 Nov. 25, 2021

Related U.S. Application Data

(60) Provisional application No. 62/704,706, filed on May 23, 2020.

(51) Int. Cl.
*E02F 3/36* (2006.01)

(52) U.S. Cl.
CPC ..... *E02F 3/3631* (2013.01); *E02F 3/3668* (2013.01)

(58) Field of Classification Search
CPC ..... E02F 3/3631; E02F 3/3668
USPC ..... 414/723
See application file for complete search history.

(56) References Cited

U.S. PATENT DOCUMENTS

| | | | | |
|---|---|---|---|---|
| 5,685,689 | A | 11/1997 | Schneider et al. | |
| 6,238,130 | B1 * | 5/2001 | Youngers | E02F 3/3627 403/324 |
| 7,073,972 | B1 * | 7/2006 | Schumacher | E02F 3/3672 403/382 |
| 7,779,562 | B1 * | 8/2010 | Loveless | E02F 3/3686 37/231 |
| 2013/0051964 | A1 * | 2/2013 | Bernier | E02F 3/96 414/722 |
| 2015/0020892 | A1 * | 1/2015 | Behr | E02F 3/3672 137/15.09 |
| 2015/0275466 | A1 * | 10/2015 | Behr | E02F 3/3672 403/34 |
| 2016/0208455 | A1 * | 7/2016 | Martin | E02F 3/364 |
| 2019/0127954 | A1 * | 5/2019 | Erhardt | E02F 3/3627 |
| 2020/0325648 | A1 * | 10/2020 | Nishi | E02F 3/3627 |

* cited by examiner

*Primary Examiner* — Saul Rodriguez
*Assistant Examiner* — Brendan P Tighe
(74) *Attorney, Agent, or Firm* — Victor H. Segura

(57) ABSTRACT

A system for connecting an implement to a machine. A universal adapter to connect implements with machines. A frame with brackets on one side to couple to lift arms and tilt operators on a machine such as an earthmoving vehicle. Brackets on the other side of the frame to detachably couple to the implement. A locking mechanism on the frame with operative handles to engage locking pins on the adapter with the implement between a release and locked position.

15 Claims, 4 Drawing Sheets

IMPLEMENT QUICK CONNECT SYSTEM

CROSS REFERENCE TO RELATED APPLICATIONS

This application claims priority to U.S. Provisional Application No. 62/704,706 filed on May 23, 2020. The entire disclosure of Application No. 62/704,706 is hereby incorporated herein by reference.

FIELD OF THE INVENTION

The present disclosure relates generally to quick connect systems for detachably attaching working implements (e.g. a bucket) to machinery or vehicles such as earthmoving vehicles or the like.

BACKGROUND

Industrial machinery are designed to perform various functions according to the type of implement attached to the device. Machines such as earthmoving vehicles are designed to preform various jobs using various implements. Different structures are available to connect a bucket or other implement to the vehicle, which is configured with lift arms and tilt links to engage and retain the implement. For example, a vehicle can be equipped with a bucket attached as an implement to perform various material transport and transfer operations. A vehicle equipped with a fork implement is useful for the transfer of palletized goods, for example. A vehicle equipped with gripping hooks may be used to perform various pulling and hauling operations. Thus, a single machine can serve multiple purposes by replaceably attaching a desired implement thereto according to the nature of the work required. Conventional mounting structures for implements are relatively complex and expensive. A need remains for improved, low cost, universal application, quick connect systems that provide reliability and ease of use.

SUMMARY

A system for connecting an implement to a machine according to the present disclosure includes a frame having a top end, a bottom end, a front side, and a back side. A first receiving bracket is disposed on the back side of the frame near a first end of the frame. A second receiving bracket is disposed on the back side of the frame near a second end of the frame. The first and second receiving brackets are configured to respectively couple to first and second lift arms and first and second tilt operators on a machine. A first implement engagement bracket is disposed on the front side of the frame near the first end of the frame. A second implement engagement bracket is disposed on the front side of the frame near the second end of the frame. The first and second implement engagement brackets each being configured to detachably couple to an implement. A locking mechanism includes: a first handle disposed near the first end of the frame, the first handle linked to a first connecting rod linked to a first locking pin; wherein the first handle is operative to move the first connecting rod to move the first locking pin to engage with the implement between a locked position and a release position; a second handle disposed near the second end of the frame, the second handle linked to a second connecting rod linked to a second locking pin; wherein the second handle is operative to move the second connecting rod to move the second locking pin to engage with the implement between a locked position and a release position.

In some embodiments, the first handle is disposed on the first implement engagement bracket and the second handle is disposed on the second implement engagement bracket.

In some embodiments, the first and second handles are disposed on the respective first and second implement engagement brackets such that the handles are accessible from the top end of the frame.

In some embodiments, the first locking pin on the first implement engagement bracket and the second locking pin on the second implement engagement bracket are each disposed on a bottom end of the respective bracket.

In some embodiments, the first and second connecting rods are each linked between the respective first and second locking pins and first and second handles via pivoting joints.

In some embodiments, the frame comprises a plurality of elongated members disposed between a first end plate and a second end plate.

In some embodiments, the first and second handles are configured for operability independent of one another.

In some embodiments, the implement comprises coupling means for releasable engagement with the first and second implement engagement brackets.

In some embodiments, the coupling means comprises a groove to matingly receive the first and second implement engagement brackets.

In some embodiments, the first and second implement engagement brackets are each configured with a shoulder to matingly engage the implement coupling means.

In some embodiments, the coupling means comprise first and second pin receptacles configured to respectively receive the first and second locking pins.

In some embodiments, the first and second locking pins are each configured with means to retain the pin when in the locked position in the respective pin receptacle on the implement.

In some embodiments, the first and second handles are each configured with retaining means to maintain the handle in a position wherein the respective locking pin is in a locked position with the respective pin receptacle on the implement.

In some embodiments, the first pin receptacle is disposed near a first side of the implement and the second pin receptacle is disposed near a second side of the implement.

In some embodiments, the first implement engagement bracket comprises a first sleeve to guide the first locking pin and the second implement engagement bracket comprises a second sleeve to guide the second locking pin.

In some embodiments, the first and second receiving brackets are each configured with a plurality of different sized holes distributed thereon to provide different coupling engagements for the lift arms and/or the tilt operators.

In some embodiments, the first and second receiving brackets are each configured for adjustable connection with the lift arms and/or the tilt operators.

In some embodiments, the first and second receiving brackets are each configured for adjustable placement on the back side of the frame.

In some embodiments, the first and second implement engagement brackets are each configured for adjustable placement on the front side of the frame.

In some embodiments, the first and second implement engagement brackets are rigidly affixed on the frame.

In some embodiments, the implement comprises a bucket.

BRIEF DESCRIPTION OF THE DRAWINGS

The following figures form part of the present specification and are included to further demonstrate certain aspects of the present disclosure and should not be used to limit or define the claimed subject matter. The claimed subject matter may be better understood by reference to one or more of these drawings in combination with the description of embodiments presented herein. Consequently, a more complete understanding of the present embodiments and further features and advantages thereof may be acquired by referring to the following description taken in conjunction with the accompanying drawings, in which like reference numerals may identify like elements, wherein:

DETAILED DESCRIPTION

The foregoing description of the figures is provided for the convenience of the reader. It should be understood, however, that the embodiments are not limited to the precise arrangements and configurations shown in the figures. Also, the figures are not necessarily drawn to scale, and certain features may be shown exaggerated in scale or in generalized or schematic form, in the interest of clarity and conciseness.

Figure 1:
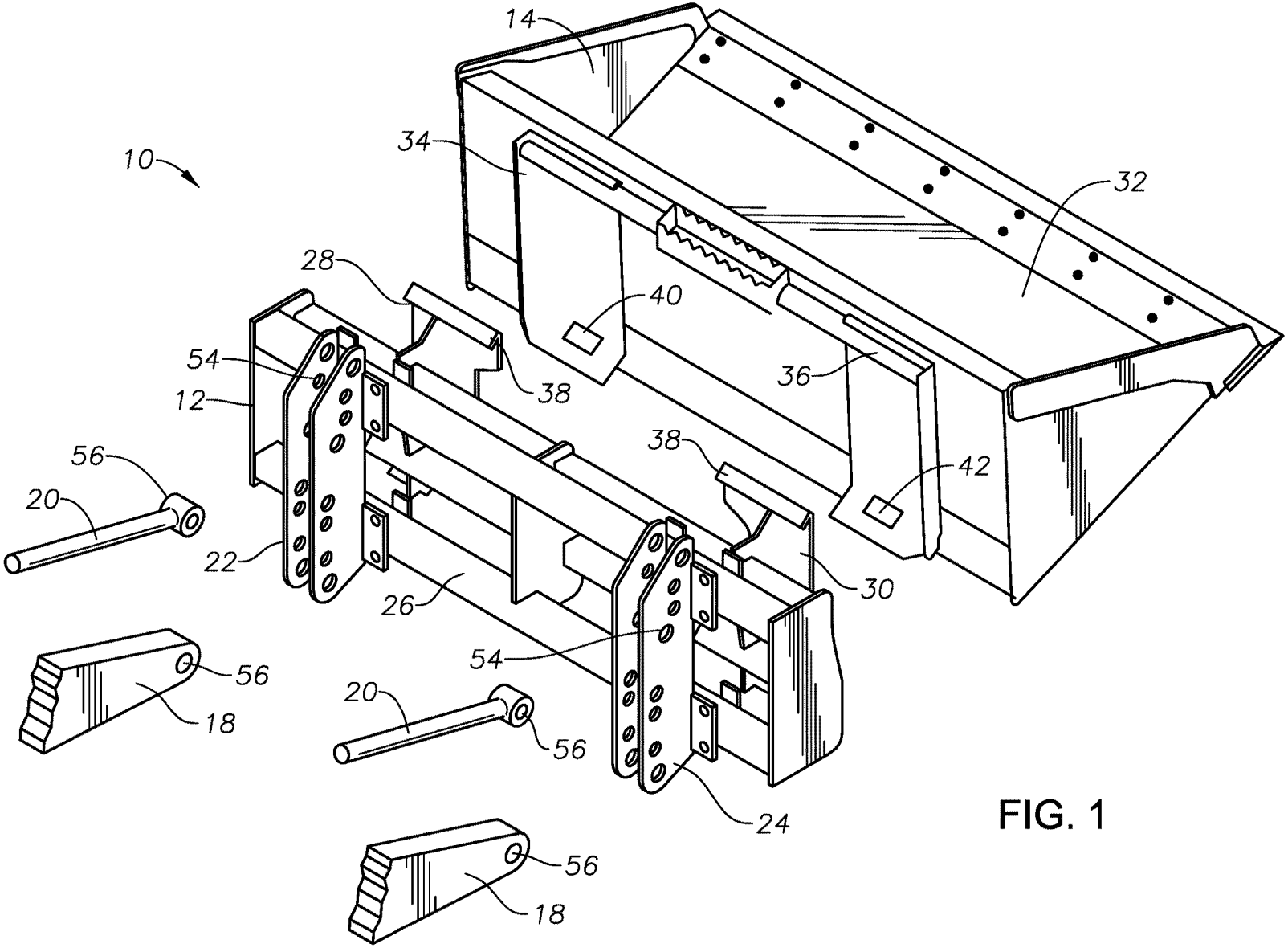
FIG. 1 shows a universal adapter for coupling an implement to a machine for a desired application according to an example of the present disclosure.

The present disclosure presents a system for quickly and securely connecting a desired implement to machinery, such as an earthmoving vehicle which is commonly referred to as a front loader. FIG. 1 shows a system 10 embodiment of this disclosure. An adapter 12 provides universal coupling means to connect an implement 14 to a machine (see item 16 in FIG. 5). In the case of a front loader vehicle, the adapter 12 may be coupled to the vehicle via a pair of lift arms 18 and tilt operators 20. The adapter 12 includes a first receiving bracket 22 and a second receiving bracket 24 respectively mounted near the opposing ends of a frame 26 that makes up the body of the adapter, as further described below. The opposite or front side of the adapter 12 includes a first implement engagement bracket 28 mounted near one end of the frame 26 and a second implement engagement bracket 30 mounted near the opposite end of the frame. As depicted in FIG. 1, the left side of the adapter 12 (closest to the lift arms 18 and tilt operators 20) is considered the back side and the opposite side the front side.

An embodiment of the implement 14 may consist of a bucket 32, which is commonly used to collect and convey solid materials such as dirt, debris, etc. Such implements 14 are typically made of metal, such as steel. The implement 14 includes coupling means 34 mounted thereon to provide for releasable engagement with the first 28 and second 30 implement engagement brackets. The coupling means 34 may be mounted onto the implement 14 via conventional fasteners (e.g. bolted) or welded thereon as known in the art. In some embodiments, the coupling means 34 may be formed as part of the implement 14 in the manufacturing process. The coupling means 34 is configured with an upside down V-shaped groove 36 formed at the upper end to matingly receive a corresponding V-shaped shoulder 38 formed at the upper end of the first 28 and second 30 implement engagement brackets. The coupling means 34 include first 40 and second 42 pin receptacles configured to respectively receive first and second locking pins as described below. The pin receptacles 40, 42 are configured as slots or holes formed on a slanted surface extending outward from the bottom end of the coupling means 34. Although FIG. 1 shows coupling means 34 configured with a unitary V-shaped groove 36 running across the width of the implement 14, other embodiments may be implemented with coupling means formed as separate and independent units to respectively engage with the first 28 and second 30 implement engagement brackets.

Figure 2:
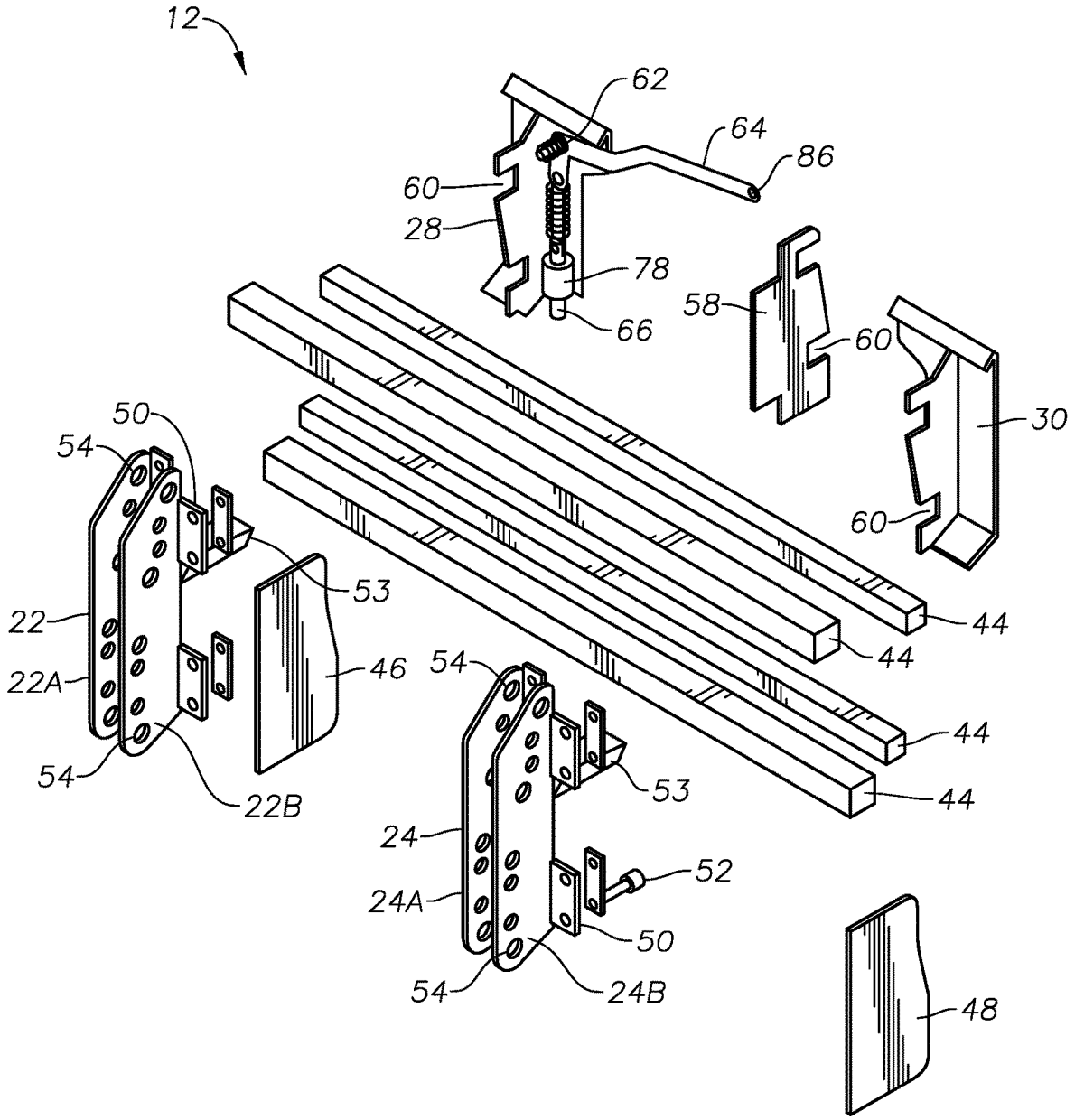
FIG. 2 shows the universal adapter of FIG. 1 in an exploded view.

Turning to FIG. 2, an embodiment of an adapter 12 is shown with its individual components in an exploded view. The adapter 12 frame 26 consists of multiple parts. Central to the adapter 12 are a plurality of elongated members 44. The members 44 may be formed in any of various shapes as desired (e.g., rods, quadrilateral bars, triangular pieces, etc.). The elongated members 44 are sandwiched between a first end plate 46 and a second end plate 48. The end plates 46, 48 may be welded to the ends of the elongated members 44 or affixed via other conventional means as known in the art. The first receiving bracket 22 and the second receiving bracket 24 are configured with mounting brackets 50 at the upper and lower ends. In some embodiments, the adapter 12 frame 26 is configured with the mounting brackets 50 secured to the elongated members 44 via conventional fasteners 52 (e.g. nuts-bolts), as shown in FIG. 2. By using releasable mounting brackets 50, the position of the first 22 and second 24 receiving brackets can be adjusted on the frame 26 to accommodate for the separation of the lift arms 18 and tilt operators 20 on different machines. In some embodiments, the first 22 and second 24 receiving brackets can be rigidly affixed to the frame 26 (e.g., via welding or conventional fasteners as known in the art). Each of the receiving brackets 22, 24 is configured with a series of holes 54 distributed along the bracket sides to accommodate for the separation of the lift arms 18 and tilt operators 20 on the machine and to allow for engagement of the adapter 12 at different tilt angles. The lift arms 18 and tilt operators 20 are configured with holes 56 on the ends (see FIG. 1) to provide for coupling engagement with the holes 54 in the brackets 22, 24 using conventional fasteners as known in the art (e.g., nuts-bolts, detachable pins, etc.). A divider plate 58 is nested in between the elongated members 44 (see FIG. 1) to provide stability to the frame 26. The plate 58 may be welded in place or affixed with conventional fasteners as known in the art. In some embodiments, the first 22 and second 24 receiving brackets may be implemented with a support member 53 or gusset to provide additional load-bearing support. With the frame 26 configured, the engaged elongated member 44 resides atop the support member 53. The first 22 and/or second 24 receiving brackets may be implemented with multiple support members 53. Other embodiments may be configured with the support member 53 implemented on the elongated member 44 to engage with the receiving brackets 22, 24.

The first 28 and second 30 implement engagement brackets, and the divider plate 58, are configured with slots or cutouts 60 to mesh and interlock with the elongated members 44 (see FIG. 1). Embodiments may be implemented with the implement engagement brackets 28, 30 detachably mounted on the frame 26 or rigidly mounted on the frame, similar to the mounting options of the first 22 and second 24 receiving brackets. The implement engagement brackets 28, 30 are each equipped with a locking mechanism 62 including a handle 64 configured to selectively engage a locking pin 66 to securely couple the implement 14 to the adapter 12. For clarity of illustration, only one implement engagement bracket 28 is shown equipped with a locking mechanism 62. Embodiments are preferably implemented with each implement engagement bracket 28, 30 equipped with its own separate locking mechanism 62 (see FIG. 5).

Figure 3:
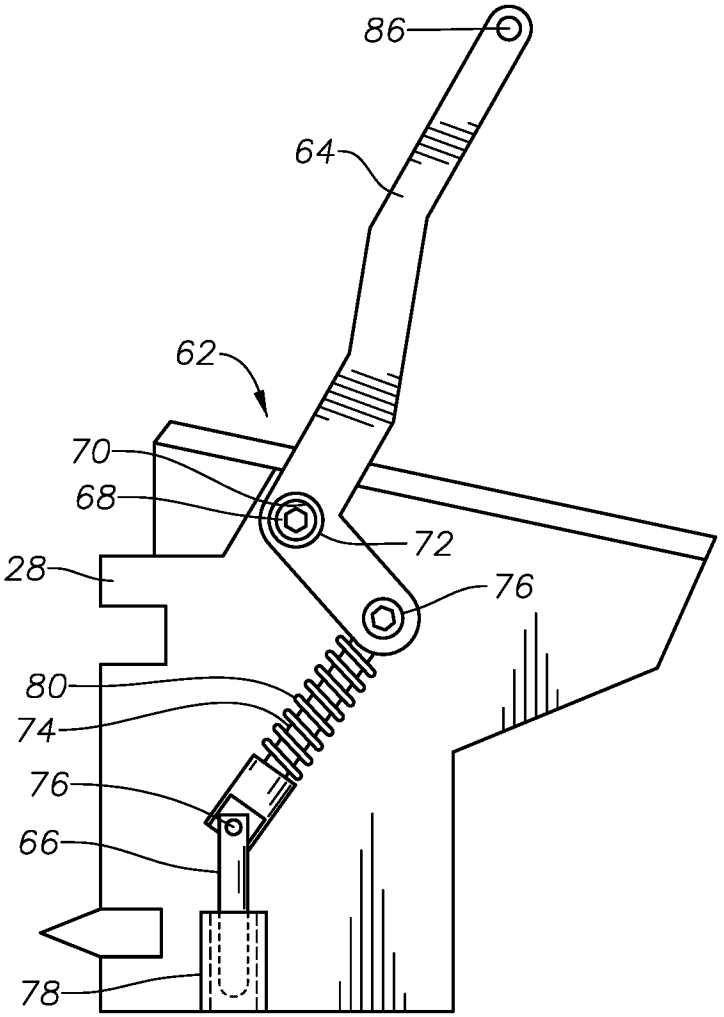
FIG. 3 shows a schematic of a locking mechanism according to an example of the present disclosure.

FIG. 3 shows an embodiment of the locking mechanism 62. The locking mechanism 62 is shown with the locking pin 66 in the unlocked or release position. The handle 64 is mounted on the implement engagement bracket 28 via a pin 68 extending outward on one side of the bracket to engage a hole 70 in the handle. The pin 68 provides a pivot point for the handle 64. A nut at the end of a threaded pin 68, or other conventional retainer means, may be used to retain the handle 64 on the pin. In some embodiments, a spring 72 may be disposed on the pin 68 to abut against the retainer means, thereby providing a compressive force against the handle 64 to keep it from moving loosely. A connecting rod 74 is pivotably linked in between the handle 64 and the locking pin 66 via pin joints 76 at each end of the connecting rod. The lower end of the implement engagement bracket 28 is configured with a collar or sleeve 78 that guides the locking pin 66. The sleeve 78 may be affixed to the implement engagement bracket 28 via welding or it may be integrally formed on the bracket via conventional manufacturing techniques as known in the art. The sleeve 78 allows the locking pin 66 to slide up or down when operatively manipulated via the handle 64. In some embodiments, the connecting rod 74 may be formed with a threaded end to couple with mating threads at the upper or lower joint 76. With such embodiments, the connecting rod 74 may be varied in length as needed. A spring 80 may also be interposed over the connecting rod 74 to maintain the joints 76 under tension to keep the rod from inadvertently turning.

Figure 4:
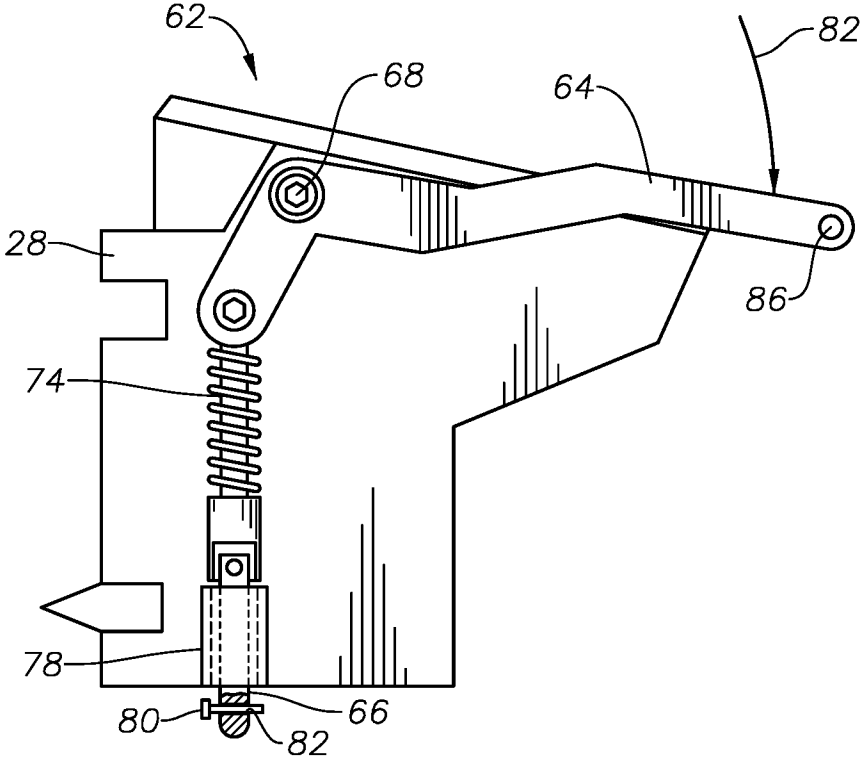
FIG. 4 shows another schematic of a locking mechanism according to an example of the present disclosure.

FIG. 4 shows the locking mechanism 62 with the locking pin 66 in the extended or locked position. When the handle 64 is pushed down (represented by arrow 82), the lower end of the handle pivots on pin 68, which moves connecting rod 74, which in turn moves the locking pin 66 through the sleeve 78, causing the pin to extend and protrude outward from the bottom end of the implement engagement bracket 28.

Figure 5:
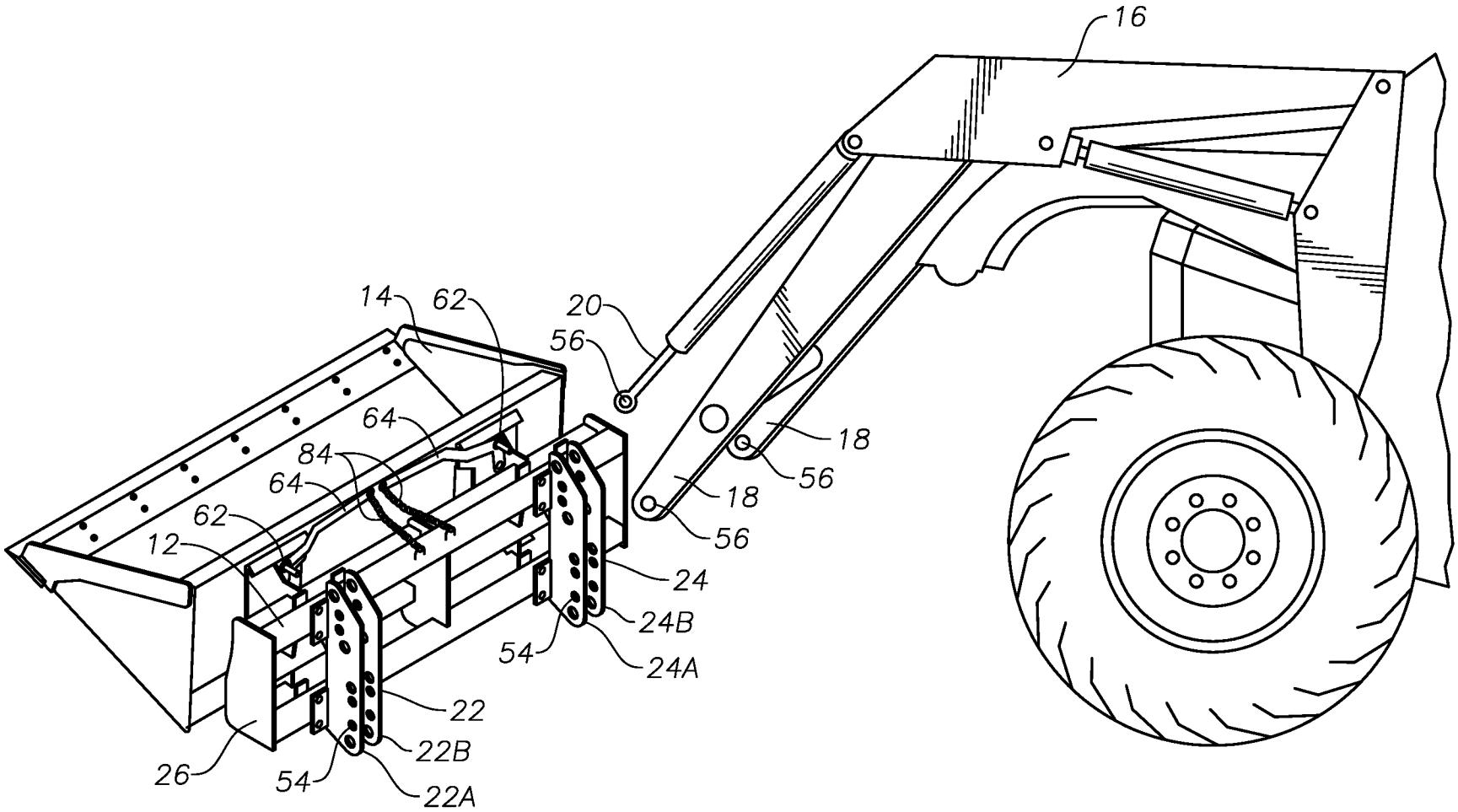
FIG. 5 shows a schematic of a universal adapter and an earthmoving vehicle according to an example of the present disclosure.

When the adapter 12 is coupled to the implement 14 via engagement of the implement engagement brackets 28, 30 and the implement coupling means 34, the locking mechanism 62 handle 64 on each engagement bracket can be independently operated and lowered to extended each locking pin 66 to pass through the respective pin receptacle 40, 42 to secure the implement in a locked position (see FIG. 5). In some embodiments, the locking pins 66 may be configured with means to retain the pin in the extended or locked position in the respective pin receptacle 40, 42. For example, an embodiment may be implemented with means to retain the locking pin 66 including a detachable spring-loaded pin 80 that is inserted in a hole 82 formed near the tip of the locking pin, such that when the locking pin extends outward from the bottom of the pin receptacle 40, 42, the pin 80 provides a physical detent to prevent the locking pin from disengaging. Other embodiments may be implemented with means to retain the locking pin 66 in the locked position using conventional detent or securing techniques as known in the art.

Turning to FIG. 5, in some embodiments each handle 64 may also be configured with retaining means to maintain the handle in the down position to prevent the linked locking pin 66 from inadvertently disengaging from the locked position to the release position. In some embodiments, the retaining means may be implemented via a pair of chains 84 affixed to the top end of the frame 26 (e.g., via welded eyelets) near the center, such that when the first and second handles 64 are lowered to the locked position, a retaining clip at the end of each chain is engaged with a hole 86 near the tip of each handle to maintain the handle in that position. Other retaining means may be implemented via conventional bracket or fastener means as known in the art.

Among the advantages provided by the present invention is the universal application of the adapter 12. The quick-connect applicability of the disclosed adapter 12 opens it to universal application in terms of the machines which can be connected to the adapter. As previously discussed, some embodiments of this disclosure may be implemented with first 22 and second 24 receiving brackets that can be adjusted on the frame 26 to accommodate for the separation of the lift arms 18 and tilt operators 20 on different machines 16 (e.g., a front end loader). Some embodiments of the first 22 and second 24 receiving brackets provide additional versatility.

Embodiments of the first 22 and second 24 receiving brackets include brackets formed in separate halves 22A, 22B, 24A, and 24B (see FIGS. 2 & 5). With such embodiments, each bracket half 22A, 22B, 24A, 24B may be configured with its own set of mounting brackets 50. Additionally, each bracket half 22A, 22B, 24A, 24B may be implemented with multiple apertures or holes 54 of different sizes formed and distributed on the bracket to accommodate different size pins used to connect lift arms 18 and tilt operators 20 with different hole sizes 56. The independent bracket halves 22A, 22B, 24A, 24B may also be conveniently separated apart or brought closer together for placement on the frame 26 to accept and connect with machines equipped with lift arms 18 and tilt operators 20 (or their equivalents) having various dimensions, as well as allowing for engagement of the adapter 12 at different tilt angles. With the adapter 12 embodiments of this disclosure, an operator does not have to know any information (e.g., model number or pin size) regarding the coupling engagements of the machine to be used, thereby providing a universal adapter.

In light of the principles and example embodiments described and depicted herein, it will be recognized that the example embodiments can be modified in arrangement and detail without departing from such principles. It will be appreciated by those skilled in the art that embodiments of this disclosure may be implemented using conventional materials, parts, and components suitable for the desired application (e.g., components made of metal, hybrid composites, etc.). It will also be appreciated that the types of implements that may applied with the disclosed system are unlimited (e.g., buckets, lifting forks, gripping hooks, etc.), What is claimed as the invention,

What is claimed is:

1. A system for connecting an implement to a machine, comprising:

a frame having a top end, a bottom end, a front side, and a back side;

a first receiving bracket disposed on the back side of the frame near a first end of the frame;

a second receiving bracket disposed on the back side of the frame near a second end of the frame;

the first and second receiving brackets configured for adjustable engagement on the frame for movable placement of each bracket at a selected position on the frame;

the first and second receiving brackets configured to respectively couple to first and second lift arms and first and second tilt operators on a machine, wherein the first and second receiving brackets are each configured with multiple holes distributed thereon to provide different coupling engagements for the first and second lift arms and/or the first and second tilt operators;

a first implement engagement bracket disposed on the front side of the frame near the first end of the frame;

a second implement engagement bracket disposed on the front side of the frame near the second end of the frame;

the first and second implement engagement brackets configured for adjustable engagement on the frame for movable placement of each bracket at a selected position on the frame;

the first and second implement engagement brackets each being configured to detachably couple to an implement; and a locking mechanism, including a first handle disposed near the first end of the frame, the first handle linked to a first connecting rod linked to a first locking pin;

wherein the first handle is operative to move the first connecting rod to move the first locking pin to engage with the implement between a locked position and a release position;

a second handle disposed near the second end of the frame, the second handle linked to a second connecting rod linked to a second locking pin;

wherein the second handle is operative to move the second connecting rod to move the second locking pin to engage with the implement between a locked position and a release position.

2. The system of claim 1 wherein the first handle is disposed on the first implement engagement bracket and the second handle is disposed on the second implement engagement bracket.

3. The system of claim 2 wherein the first and second handles are disposed on the respective first and second implement engagement brackets such that the handles are accessible from the top end of the frame.

4. The system of claim 3 wherein the first locking pin on the first implement engagement bracket and the second locking pin on the second implement engagement bracket are each disposed on a bottom end of the respective bracket.

5. The system of claim 4 wherein the first and second connecting rods are each linked between the respective first and second locking pins and first and second handles via pivoting joints.

6. The system of claim 5 wherein the frame comprises a plurality of elongated members disposed between a first end plate and a second end plate.

7. The system of claim 6 wherein the first and second handles are configured for operability independent of one another.

8. The system of claim 7 wherein the implement comprises coupling means for releasable engagement with the first and second implement engagement brackets.

9. The system of claim 8 wherein the coupling means comprises a groove to matingly receive the first and second implement engagement brackets.

10. The system of claim 9 wherein the first and second implement engagement brackets are each configured with a shoulder to matingly engage the implement coupling means.

11. The system of claim 10 wherein the coupling means comprise first and second pin receptacles configured to respectively receive the first and second locking pins.

12. The system of claim 11 wherein the first and second locking pins are each configured with means to retain the pin when in the locked position in the respective pin receptacle on the implement.

13. The system of claim 12 wherein the first and second handles are each configured with retaining means to maintain the handle in a position wherein the respective locking pin is in a locked position with the respective pin receptacle on the implement.

14. The system of claim 13 wherein the first pin receptacle is disposed near a first side of the implement and the second pin receptacle is disposed near a second side of the implement.

15. The system of claim 11 wherein the first implement engagement bracket comprises a first sleeve to guide the first locking pin and the second implement engagement bracket comprises a second sleeve to guide the second locking pin.

* * * * *